US006105288A

United States Patent [19]

Becker

[11] Patent Number: 6,105,288

[45] Date of Patent: Aug. 22, 2000

[54] TOMBSTONE PICTURE DISPLAY

[76] Inventor: Vicki D. Becker, 729 Jamestown Ct., Green Bay, Wis. 54301

[21] Appl. No.: 09/415,006

[22] Filed: Oct. 8, 1999

[51] Int. Cl.[7] ..... G09F 19/00; H47G 1/06

[52] U.S. Cl. ..... 40/124.5; 40/781

[58] Field of Search ..... 40/124.5, 768, 40/780, 781

[56] References Cited

U.S. PATENT DOCUMENTS

| | | | |
|---|---|---|---|
| 4,033,060 | 7/1977 | Lawrence | 40/768 |
| 5,383,293 | 1/1995 | Royal | 40/768 |
| 5,400,532 | 3/1995 | Grove | 40/721 |

*Primary Examiner*—Cassandra Davis

[57] ABSTRACT

A tombstone picture display for displaying photos, pictures, and other images on a tombstone. The tombstone picture display includes a holder for mounting to a tombstone which has front, back, and top faces. The holder also has a slot in the top face of the holder and a front opening in the front face of the holder in communication with the slot of the holder. A cover is also included with inner and outer faces, and a window to permit viewing through the cover between the inner and outer faces of the cover. The inner face of the housing is coupled to the front face of the holder such that the cover covers the front face of the holder and the front opening of the holder is visible through the window of the cover.

7 Claims, 3 Drawing Sheets

TOMBSTONE PICTURE DISPLAY

BACKGROUND OF THE INVENTION

1. Field of the Invention

The present invention relates to tombstone picture displays and more particularly pertains to a new tombstone picture display for displaying photos, pictures, and other images on a tombstone.

2. Description of the Prior Art

The use of tombstone picture displays is known in the prior art. More specifically, tombstone picture displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,848,014; 5,787,625; 953,053; 4,914,842; 4,227,325; and U.S. Pat. No. Des. 307,676.

While these devices fulfill their respective, particular objectives and requirements, the aforementioned patents do not disclose a new tombstone picture display. The inventive device includes a holder for mounting to a tombstone which has front, back, and top faces. The holder also has a slot in the top face of the holder and a front opening in the front face of the holder in communication with the slot of the holder. A cover is also included with inner and outer faces, and a window to permit viewing through the cover between the inner and outer faces of the cover. The inner face of the housing is coupled to the front face of the holder such that the cover covers the front face of the holder and the front opening of the holder is visible through the window of the cover.

In these respects, the tombstone picture display according to the present invention substantially departs from the conventional concepts and designs of the prior art, and in so doing provides an apparatus primarily developed for the purpose of displaying photos, pictures, and other images on a tombstone.

SUMMARY OF THE INVENTION

In view of the foregoing disadvantages inherent in the known types of tombstone picture displays now present in the prior art, the present invention provides a new tombstone picture display construction wherein the same can be utilized for displaying photos, pictures, and other images on a tombstone.

The general purpose of the present invention, which will be described subsequently in greater detail, is to provide a new tombstone picture display apparatus and method which has many of the advantages of the tombstone picture displays mentioned heretofore and many novel features that result in a new tombstone picture display which is not anticipated, rendered obvious, suggested, or even implied by any of the prior art tombstone picture displays, either alone or in any combination thereof.

To attain this, the present invention generally comprises a holder for mounting to a tombstone which has front, back, and top faces. The holder also has a slot in the top face of the holder and a front opening in the front face of the holder in communication with the slot of the holder. A cover is also included with inner and outer faces, and a window to permit viewing through the cover between the inner and outer faces of the cover. The inner face of the housing is coupled to the front face of the holder such that the cover covers the front face of the holder and the front opening of the holder is visible through the window of the cover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tombstone picture display apparatus and method which has many of the advantages of the tombstone picture displays mentioned heretofore and many novel features that result in a new tombstone picture display which is not anticipated, rendered obvious, suggested, or even implied by any of the prior art tombstone picture displays, either alone or in any combination thereof.

It is another object of the present invention to provide a new tombstone picture display which may be easily and efficiently manufactured and marketed.

It is a further object of the present invention to provide a new tombstone picture display which is of a durable and reliable construction.

An even further object of the present invention is to provide a new tombstone picture display which is susceptible of a low cost of manufacture with regard to both materials and labor, and which accordingly is then susceptible of low prices of sale to the consuming public, thereby making such tombstone picture display economically available to the buying public.

Still yet another object of the present invention is to provide a new tombstone picture display which provides in the apparatuses and methods of the prior art some of the advantages thereof, while simultaneously overcoming some of the disadvantages normally associated therewith.

Still another object of the present invention is to provide a new tombstone picture display for displaying photos, pictures, and other images on a tombstone.

Yet another object of the present invention is to provide a new tombstone picture display which includes a holder for mounting to a tombstone which has front, back, and top faces. The holder also has a slot in the top face of the holder and a front opening in the front face of the holder in communication with the slot of the holder. A cover is also included with inner and outer faces, and a window to permit viewing through the cover between the inner and outer faces of the cover. The inner face of the housing is coupled to the front face of the holder such that the cover covers the front face of the holder and the front opening of the holder is visible through the window of the cover.

Still yet another object of the present invention is to provide a new tombstone picture display that lets a user display images on a tombstone relating to an aspect of a deceased's life.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
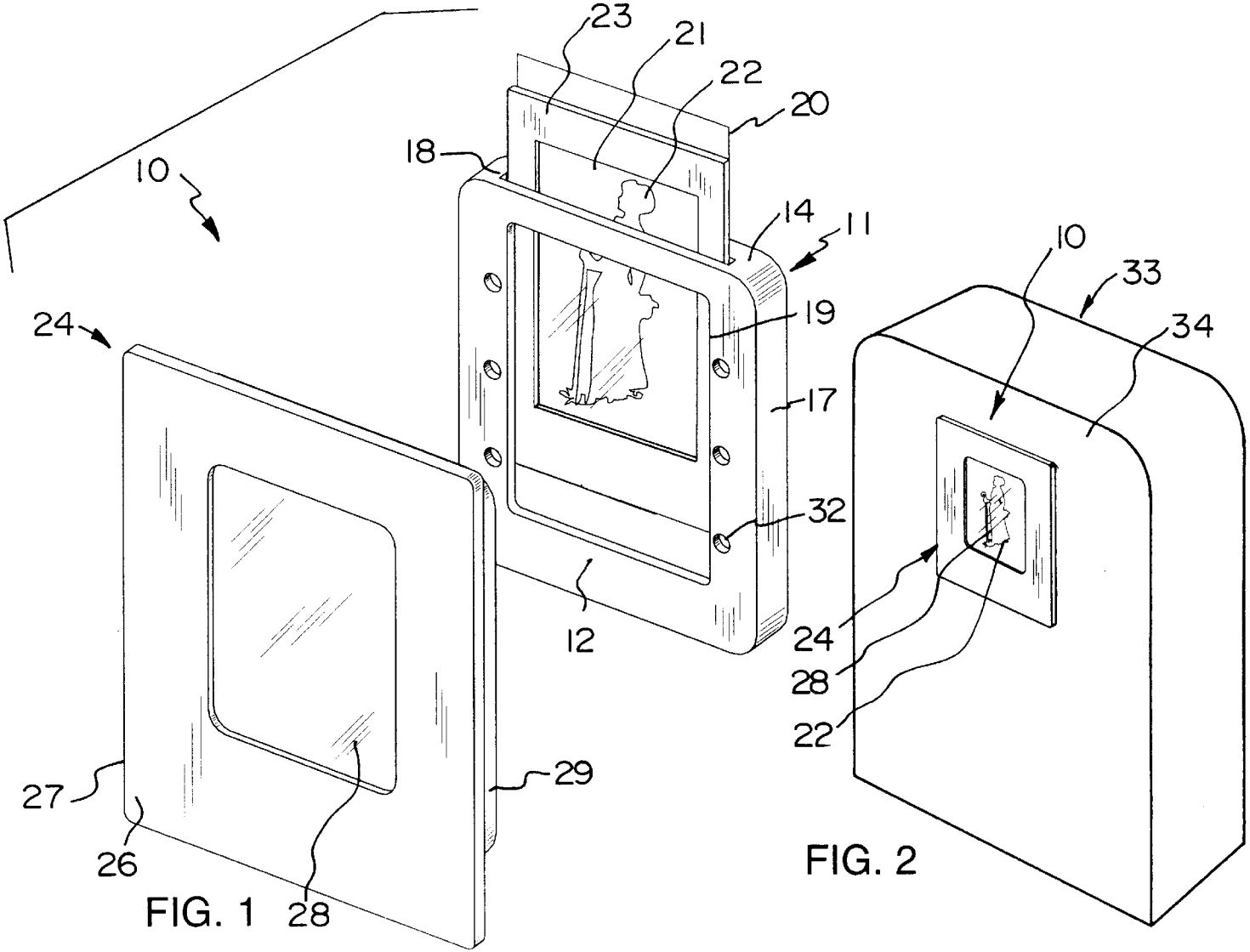
FIG. 1 is a schematic exploded front perspective view of a new tombstone picture display according to the present invention.
FIG. 2 is a schematic perspective view of the present invention on a tombstone.
Figure 4:
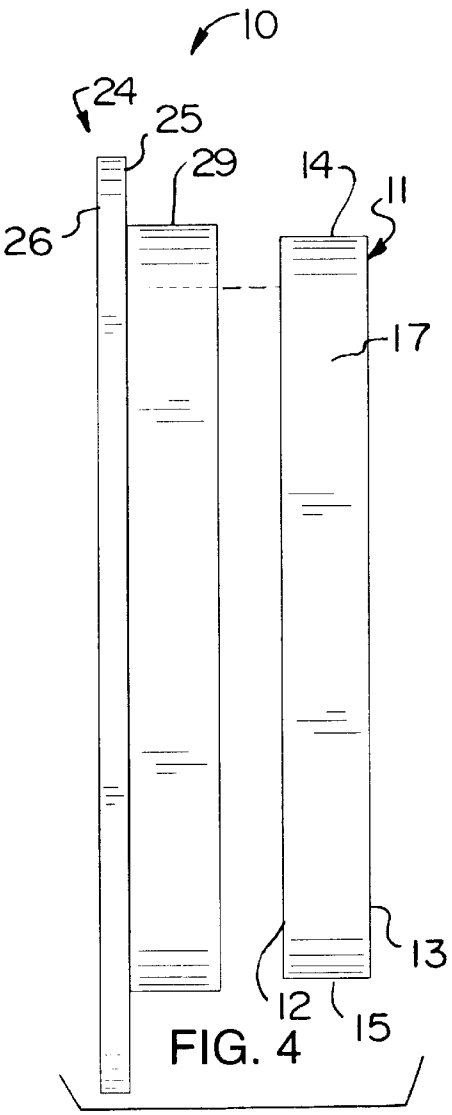
FIG. 4 is a schematic side exploded view of the present invention.

With reference now to the drawings, and in particular to FIGS. 1 through 5 thereof, a new tombstone picture display embodying the principles and concepts of the present invention and generally designated by the reference numeral 10 will be described.

As best illustrated in FIGS. 1 through 5, the tombstone picture display 10 generally comprises a holder for mounting to a tombstone which has front, back, and top faces. The holder also has a slot in the top face of the holder and a front opening in the front face of the holder in communication with the slot of the holder. A cover is also included with inner and outer faces, and a window to permit viewing through the cover between the inner and outer faces of the cover. The inner face of the housing is coupled to the front face of the holder such that the cover covers the front face of the holder and the front opening of the holder is visible through the window of the cover.

In closer detail, a picture display 10 includes a picture holder 11 having substantially planar front and back faces 12,13 and a generally rectangular outer perimeter comprising top and bottom faces 14,15, and a pair of side faces 16,17 extending between the top and bottom faces of the holder. The holder has a slot 18 in the top face of the holder and a front opening 19 in the front face of the holder in communication with the slot of the holder. In one embodiment, the front opening of the holder may have a generally rectangular outer periphery.

A generally rectangular sheet 20 is inserted into the slot of the housing such that an image face 21 of the sheet is exposed in the front opening of the holder. The image face of the sheet has an image 22 displayed thereon. The image may be a photo, a picture or other image relating to an aspect the deceased's life. Optionally, a generally rectangular matte open frame 23 may also be inserted into slot of the housing between the front opening of the housing and the image face of the sheet so that the frame is extended around the image of the image face of the sheet to enable viewing of the image through the front opening.

The display also includes a substantially planar cover 24 having substantially planar inner and outer faces 25,26 and a generally rectangular outer perimeter 27. The cover also has a generally rectangular translucent and/or transparent window pane 28 extending between the inner and outer faces of the cover to permit viewing through the cover between the inner and outer faces of the cover.

The cover may also have a generally rectangular side wall 29 outwardly extending from the inner face of the cover around the window of the cover to define a generally rectangular receptacle. The side wall of the cover may be spaced inwards from the outer perimeter of the cover such that the side wall and the outer perimeter of the cover define therebetween an outer flange region 30 of the cover.

The receptacle of the cover receives therein the front face of the holder. The cover covers the front face of the housing so that the image of the sheet is visible through the window of the cover. The side wall covers the slot of the housing so that precipitation and other debris cannot pass into the slot.

Figure 3:
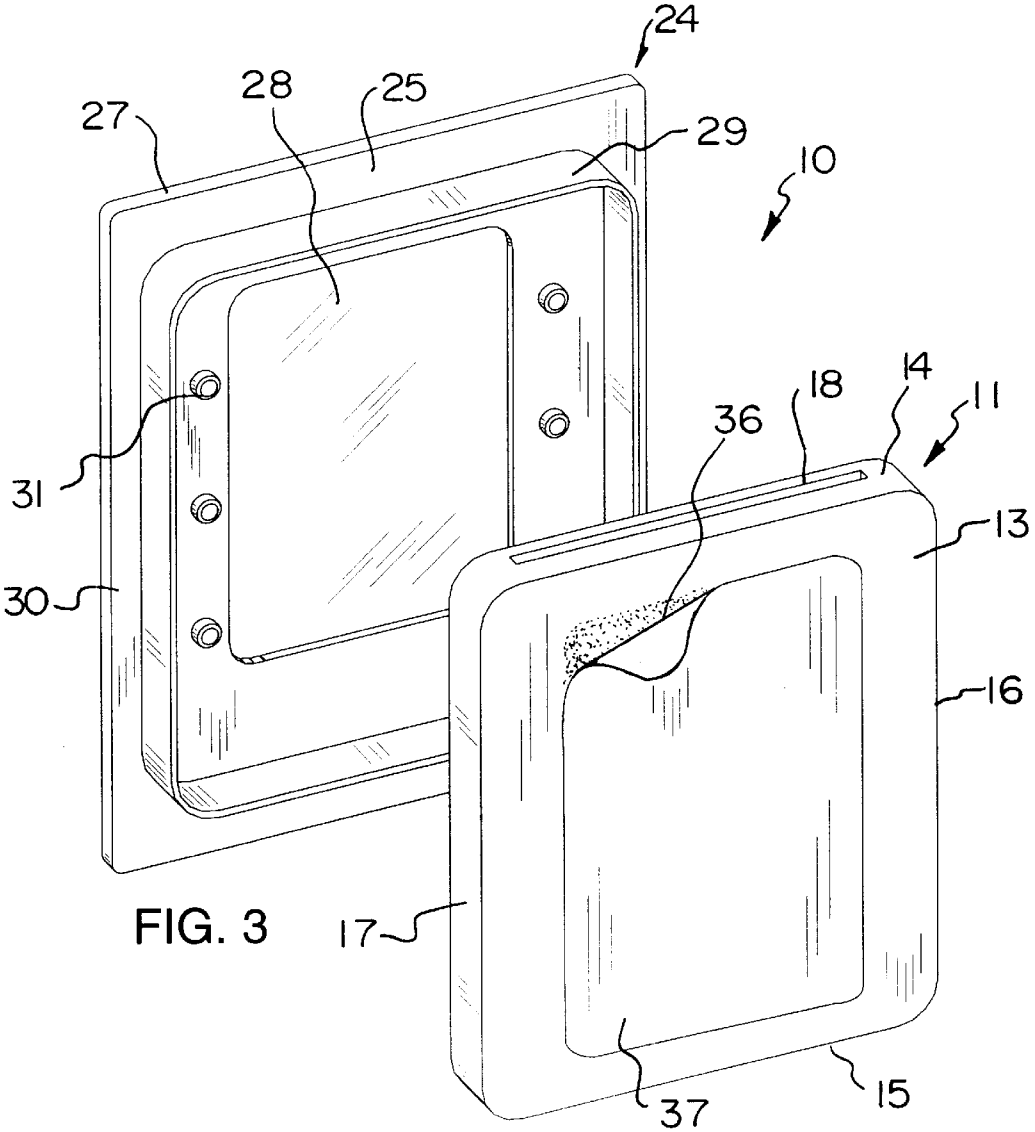
FIG. 3 is a schematic exploded back perspective view of the present invention.
Figure 5:
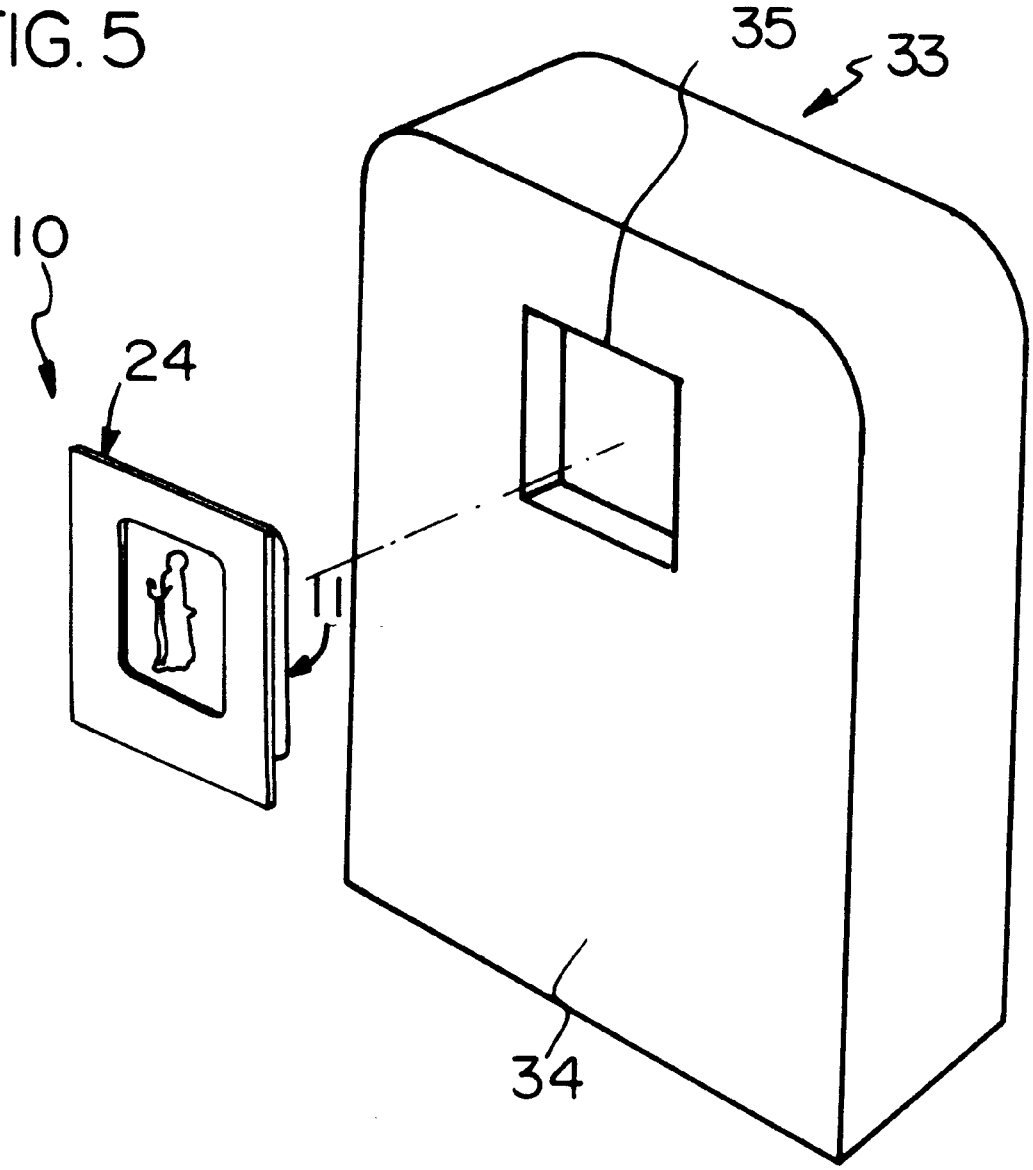
FIG. 5 is a schematic exploded perspective view of the present invention with a tombstone.

The inner face of the cover is coupled to the front face of the holder. In one embodiment, a plurality of snap fasteners couple the inner face of the cover to the front face of the holder. With reference to FIGS. 1 and 3, each snap fastener may comprise a resilient stud 31 outwardly extending from the inner face of the cover into the receptacle of the cover, and a socket 32 in the front face of the holder. The stud of each snap fastener is inserted into the socket of the respective snap fastener to couple the inner face of the cover to the front face of the holder.

In one embodiment, the snap fasteners may be arranged in a pair of rows with the window and front opening interposed between the rows of the snap fasteners. In such an embodiment, the snap fasteners may also be spaced apart at equal intervals in the respective row of snap fasteners.

The picture display is designed for use in conjunction with a tombstone 33 having a substantially planar face 34 for engraving an inscription thereon. This face of the tombstone may have a cavity 35 formed therein. In one embodiment, the cavity of the tombstone may have a generally rectangular outer periphery.

The holder and the side wall of the cover is inserted into the cavity in the face of the tombstone such that the window of the cover faces outwardly away from the face of the tombstone. The outer flange region of the cover may abut the face of the tombstone around the cavity in the face of the cavity to help prevent precipitation and debris from passing between the cavity and the picture display.

The holder is also coupled to the tombstone to mount the picture display to the tombstone. In one embodiment, the back face of the holder has an adhesive 36 thereon for adhesively coupling the back face of the holder to a portion of the tombstone in the cavity in the face of the tombstone. The back face of the holder may have a peelable removable protective backing sheet 37 covering the adhesive which is removed prior to adhesion of the adhesive to the tombstone.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A picture display for mounting to a tombstone, comprising:

a holder for mounting to a tombstone and having front, back, and top faces;

said holder having a slot in said top face of said holder;

said holder having a front opening in said front face of said holder in communication with said slot of said holder;

a cover having inner and outer faces, and a window to permit viewing through said cover between said inner and outer faces of said cover;

said inner face of said housing being coupled to said front face of said holder such that said cover covers said front face of said holder and said front opening of said holder is visible through said window of said covers;

wherein said cover has a side wall outwardly extending from said inner face of said cover around said window of said cover, said side wall of said cover defining a receptacle receiving therein said front face of said holder; and wherein a plurality of snap fasteners couple said inner face of said cover to said front face of said holder.

2. The picture display of claim 1, further comprising a sheet being inserted into said slot of said housing such that an image face of said sheet is exposed in said front opening of said holder, said image face of said sheet having an image displayed thereon.

3. The picture display of claim 2, further comprising an open frame being inserted into slot of said housing between said front opening of said housing and said image face of said sheet so that said frame is extended around said image of said image face of said sheet.

4. The picture display of claim 1, wherein each snap fastener comprises a resilient stud outwardly extending from said inner face of said cover into said receptacle of said cover, and a socket in said front face of said holder, said stud of each snap fastener being inserted into said socket of the respective snap fastener to couple said inner face of said cover to said front face of said holder.

5. The picture display of claim 1, wherein said back face of said holder has an adhesive thereon adapted for adhesively coupling to the tombstone.

6. An picture display system, comprising:

a picture display comprising:

a holder having substantially planar front and back faces and a generally rectangular outer perimeter comprising top and bottom faces, and a pair of side faces extending between said top and bottom faces of said holder;

said holder having a slot in said top face of said holder;

said holder having a front opening in said front face of said holder in communication with said slot of said holder;

said front opening of said holder having a generally rectangular outer periphery;

a generally rectangular sheet being inserted into said slot of said housing such that an image face of said sheet is exposed in said front opening of said holder;

said image face of said sheet having an image displayed thereon;

a generally rectangular open frame being inserted into slot of said housing between said front opening of said housing and said image face of said sheet so that said frame is extended around said image of said image face of said sheet;

a substantially planar cover having substantially planar inner and outer faces and a generally rectangular outer perimeter;

said cover having a generally rectangular window;

said cover having a generally rectangular side wall outwardly extending from said inner face of said cover around said window of said cover, said side wall of said cover defining a generally rectangular receptacle;

said receptacle of said cover receiving therein said front face of said holder, said cover covering said front face of said housing such that said image of said sheet is visible through said window of said cover;

said inner face of said cover being coupled to said front face of said holder;

wherein a plurality of snap fasteners couple said inner face of said cover to said front face of said holder;

each snap fastener comprising a resilient stud outwardly extending from said inner face of said cover into said receptacle of said cover, and a socket in said front face of said holder, said stud of each snap fastener being inserted into said socket of the respective snap fastener to couple said inner face of said cover to said front face of said holder;

a tombstone having a substantially planar face for engraving an inscription thereon, said face of said tombstone having a cavity formed therein, said cavity of said tombstone having a generally rectangular outer periphery;

said holder and said side wall of said cover being inserted into said cavity in said face of said tombstone such that said window of said cover faces outwardly away from said face of said tombstone;

said holder being coupled to said tombstone to mount said picture display to said tombstone; and said back face of said holder having an adhesive thereon for adhesively coupling said back face of said holder to a portion of said tombstone in said cavity in said face of said tombstone.

7. A picture display for mounting to a tombstone, comprising:

a holder for mounting to a tombstone and having front, back, and top faces;

said holder having a slot in said top face of said holder;

said holder having a front opening in said front face of said holder in communication with said slot of said holder;

a cover having inner and outer faces, and a window to permit viewing through said cover between said inner and outer faces of said cover;

said inner face of said housing being coupled to said front face of said holder such that said cover covers said front face of said holder and said front opening of said holder is visible through said window of said cover;

said cover having a side wall outwardly extending from said inner face of said cover around said window of said cover, said side wall of said cover defining a receptacle receiving therein said front face of said holder; and a plurality of fasteners coupling said inner face of said cover to said front face of said holder.

* * * * *